US007516724B2

(12) United States Patent
Ohtsuji

(10) Patent No.: US 7,516,724 B2
(45) Date of Patent: Apr. 14, 2009

(54) TRANSMISSIBLE CONNECTING MECHANISM FOR A THROTTLE

(75) Inventor: Takamasa Ohtsuji, Saitama (JP)

(73) Assignee: Husqvarna Zenoah Co., Ltd., Saitama (JP)

( * ) Notice: Subject to any disclaimer, the term of this patent is extended or adjusted under 35 U.S.C. 154(b) by 0 days.

(21) Appl. No.: 10/577,961

(22) PCT Filed: Nov. 12, 2004

(86) PCT No.: PCT/JP2004/016855

§ 371 (c)(1),
(2), (4) Date: May 3, 2006

(87) PCT Pub. No.: WO2005/048272

PCT Pub. Date: May 26, 2005

(65) Prior Publication Data

US 2007/0068488 A1 Mar. 29, 2007

(30) Foreign Application Priority Data

Nov. 12, 2003 (JP) ..... 2003-382595

(51) Int. Cl.
*F02B 33/04* (2006.01)
*F02F 1/22* (2006.01)
*F02M 7/26* (2006.01)

(52) U.S. Cl. ..... 123/73 A; 123/73 PP; 261/23.3

(58) Field of Classification Search ..... 123/73 R, 123/65 A, 73 PP, 579, 583, 73 A; 261/23.2, 261/23.3, 45, 52, DIG. 1
See application file for complete search history.

(56) References Cited

U.S. PATENT DOCUMENTS

| | | | | |
|---|---|---|---|---|
| 3,439,658 | A | 4/1969 | Simonet | |
| 4,075,985 | A * | 2/1978 | Iwai | 123/73 A |
| 4,530,805 | A * | 7/1985 | Abbey | 261/53 |
| 4,558,676 | A * | 12/1985 | Seidl | 123/432 |
| 4,700,671 | A * | 10/1987 | Matsushita | 123/198 C |
| 4,895,184 | A * | 1/1990 | Abbey | 137/625.29 |
| 5,495,836 | A * | 3/1996 | Wakabayashi et al. | 123/339.13 |
| 5,671,713 | A * | 9/1997 | Yamaguchi et al. | 123/308 |
| 5,907,971 | A * | 6/1999 | Sato et al. | 74/96 |
| 6,216,650 | B1 * | 4/2001 | Noguchi | 123/73 A |
| 6,234,144 | B1 * | 5/2001 | Yamaguchi et al. | 123/399 |
| 6,347,787 | B1 * | 2/2002 | Tobinai et al. | 261/23.3 |

(Continued)

FOREIGN PATENT DOCUMENTS

| | | |
|---|---|---|
| JP | 52-76522 | 6/1977 |

(Continued)

*Primary Examiner*—Noah Kamen
(74) *Attorney, Agent, or Firm*—Darby & Darby PC

(57) ABSTRACT

A transmissible connecting mechanism drives a lead air control valve and an air-fuel mixture throttle valve of a carburetor of a stratified scavenging two-cycle engine in an interlocking manner. A cam plate having a cam groove is attached to an end portion of a valve shaft of the lead air control valve, and a lever is attached to a valve shaft of an air-fuel mixture throttle valve arranged within a carburetor main body. A contact element engaging with the cam groove of the cam plate is arranged in the lever. The lead air control valve and the throttle valve are urged in a valve closing direction by springs. A cam mechanism serving as the transmissible connecting mechanism is structured by the cam plate and the lever.

1 Claim, 14 Drawing Sheets

U.S. PATENT DOCUMENTS

| | | | | |
|---|---|---|---|---|
| 6,415,750 | B2 * | 7/2002 | Rosskamp et al. | 123/73 PP |
| 6,418,891 | B2 * | 7/2002 | Kobayashi | 123/73 PP |
| 2003/0011081 | A1 * | 1/2003 | Martinsson et al. | 261/64.1 |

FOREIGN PATENT DOCUMENTS

| | | |
|---|---|---|
| JP | 55-4518 | 2/1980 |
| JP | 9-268917 | 10/1997 |
| JP | 9-268918 | 10/1997 |
| JP | 10-252565 | 9/1998 |
| JP | 2000-186559 | 7/2000 |
| JP | 2000-282874 | 10/2000 |
| JP | 2000-314350 | 11/2000 |
| JP | 2001-254623 | 9/2001 |
| JP | 2001-263072 | 9/2001 |
| WO | WO 98/17902 | 4/1998 |
| WO | WO 01/51782 A1 | 7/2001 |

* cited by examiner

TRANSMISSIBLE CONNECTING MECHANISM FOR A THROTTLE

CROSS-REFERENCE TO RELATED APPLICATIONS

This application is a U.S. National Phase Application under 35 USC § 371 of International Application No. PCT/JP2004/016855, filed Nov. 12, 2004 designating the United States and published in Japanese, which claims priority from Japanese Application No. 2003-382595, filed Nov. 12, 2003.

TECHNICAL FIELD

The present invention relates to a transmissible connecting mechanism driving a lead air control valve and an air-fuel mixture throttle valve of a carburetor of a stratified scavenging two-cycle engine in an interlocking manner.

BACKGROUND ART

In conventional, a combustion control in an optimum state is executed while always keeping a balance between an amount of the air-fuel mixture and an amount of the lead air, by driving the lead air control valve and the air-fuel mixture throttle valve of the carburetor of the stratified scavenging two-cycle engine in an interlocking manner.

The stratified scavenging two-cycle engine is structured such that a lead air precedently having flown into a cylinder in a scavenging process is flown out to an exhaust port together with a combustion gas, and an air-fuel mixture flowing into the cylinder after the lead air can be stored within the cylinder. Accordingly, it is possible to prevent a so-called blow-by phenomenon, that is, the air-fuel mixture flowing into the cylinder is discharged to an atmospheric air from a exhaust port together with the combustion gas, it is possible to widely reduce an exhaust gas concentration, and it is possible to reduce a dissipation of a fuel consumption.

A transmissible connecting mechanism is used as a control mechanism which can obtain an optimum opening degree of the lead air control valve with respect to an opening degree of the throttle valve in the carburetor in order to control a timing at which the lead air and the air-fuel mixture are flown into the cylinder, an inflow amount and the like.

As the transmissible connecting mechanism driving the lead air control valve and the air-fuel mixture throttle valve of the carburetor of the stratified scavenging two-cycle engine in an interlocking manner, for example, there has been proposed a diaphragm carburetor using a cam mechanism and a link mechanism by Japanese Patent Application Laid-Open (JP-A) No. 2000-314350 (patent document 1).

The diaphragm carburetor described in JP-A No. 2000-314350 is provided with a structure shown in FIG. 12. That is, an operation lever 66 is borne in one end of a throttle valve shaft 63 of a throttle valve (not shown) arranged within a carburetor casing 60. The operation lever 66 is arranged in one end 67 of the throttle valve shaft 63 so as to be relatively non-rotatable, and is elastically urged in a valve closing direction of the throttle valve 62 via a restoring spring 68. Further, the operation lever 66 is connected to a carburetor control cable or a similar structure thereto in accordance with a non-illustrated aspect, and can regulate an opening degree of a throttle valve (not shown) arranged within the carburetor casing 60.

A lever 69 is borne to the other end 67' of the throttle valve shaft 63 so as to be relatively non-rotatable as shown in FIG. 13. In a same manner, a lever 71 is borne to an end portion 70 of a shaft 65 of the lead air control valve. The levers 69 and 71 are connected to each other via a drawbar 72. One end of the drawbar 72 is rotatably engaged with the lever 71, and the other end is arranged within a vertical slit 74 provided in a lever 69 so as to extend approximately in a rotational direction 73. Accordingly, a link mechanism serving as a transmissible connecting portion 76 is structured by the levers 69 and 71 and the drawbar 72.

The transmissible connecting portion 76 formed between a shaft 65 of the lead air control valve and the throttle valve shaft 63 is driven by a rotation of the throttle valve shaft 63, and a connection between the lead air control valve and the throttle valve 62 of the carburetor is achieved dependently on a position. As shown in FIG. 12, the restoring spring 68 works on the throttle valve shaft 63 in a valve closing direction of the throttle valve 62, and a coil spring 75 correspondingly works on the shaft 65 of the lead air control valve. The coil spring 75 determines a valve closing position of a butterfly-shaped throttle valve structured as the lead air control valve. As shown in FIG. 13, home positions of the throttle valve shaft 63 and the shaft 65 of the lead air control valve can be respectively determined by the restoring spring 68 and the coil spring 75.

As a structure of a cam mechanism serving as the transmissible connecting portion 76, as shown in FIG. 14, levers 69' and 71' respectively having a cam profile portion 80 and a cam profile portion 81 are attached to the throttle valve shaft 63 and the shaft 65. In a case that the throttle valve shaft 63 is moved against a force of the restoring spring 68 in the valve opening direction 73 together with the throttle valve within the carburetor, the shaft 65 of the lead air control valve is structured such as not to be operated at a time of an idling and in an idling lower range until an idling path portion 77 between a free end 79 of the lever 69' and a free end 78 of the lever 71' are overcome.

When the cam profile portion 80 of the free end 79 is brought into contact with the cam profile portion 81 of the free end 78, the throttle valve 62 within a intake pipe line 61 already exists at a partial load position. If the throttle valve 62 is further opened at this time point, the shaft 65 of the lead air control valve is taken in the valve opening direction 73, and a regulating distance at that time can be determined by the cam profile portions 80 and 81 of vertical edges of the levers 69' and 71'.

Patent Document 1:Japanese Patent Application Laid-Open (JP-A) No. 2000-314350

DISCLOSURE OF THE INVENTION

Problems to be Solved by the Invention

In the invention described in the Patent Document 1, the link mechanism or the cam mechanism is used as the transmissible connecting mechanism between the lead air control valve and the throttle valve of the carburetor, however, in a case of using the link mechanism, a length equal to or more than a predetermined length is required in the drawbar 72 for a purpose of rotating the levers 69 and 71 in an interlocking manner. If the length of the drawbar 72 is short, the rotation in the interlocking manner is hard to be executed between the levers 69 and 71.

In other words, considering a case that the length of the drawbar 72 is extremely short, the lever 69 and the lever 71 get closer to a state in which end portions of the levers 69 and 71 are connected by pin. At this time, a freedom degree is nearly lost between the levers 69 and 71. Even if the levers 69 and 71 are rotated, the levers 69 and 71 are rotated only at a slight amount. Further, if lengths of the levers 69 and 71 are made short, torque transmitted from one lever to the other lever becomes small, so that it is impossible to transmit a great force.

Accordingly, it is hard to make a center distance between the throttle valve shaft 7 of the carburetor and the invention described in JP-A No. 2000-314350 short, and it is hard to make an area between the carburetor and the lead air control valve small.

Further, in a case that the cam mechanism is used as the transmissible connecting mechanism as the invention described in JP-A No. 2000-314350, the restoring spring 68 and the coil spring 75 operating in the valve closing direction are arranged respectively in the throttle valve shaft 63 of the carburetor and the shaft 65 of the lead air control valve, however, if a foreign particle or the like enters into the valve shafts 63 and 65, there is a risk that the valve shafts 63 and 65 do not function normally.

In other words, when rotating in the valve opening direction even in the case that the foreign particle or the like enters into the valve shafts 63 and 65, it is possible to rotate the throttle valve of the carburetor and the lead air control valve in the interlocking manner. Accordingly, an increase of an operation load is caused in the operation lever 66 operating an opening and closing motion of the throttle valve of the carburetor, however, it is possible to rotate the throttle valve of the carburetor and the lead air control valve in a valve opening direction.

However, in the case of returning the throttle valve of the carburetor and the lead air control valve which are once opened, in the valve closing direction, one of the throttle valve of the carburetor and the lead air control valve is kept in the open state, so that only one valve is closed and the other valve can not be closed. Accordingly, there is generated a matter that a harmful exhaust gas is discharged due to a short air without supplying a normal fuel, or an excess air is supplied into the cylinder so as to cause a serious damage such as an over revolution speed, a burnout or the like of the engine.

In the case of making a spring force of the coil spring strong so as to make a return force in the valve closing direction strong, an increase of an operating load is caused in the operation lever 66 operating the opening and closing motion of the throttle valve of the carburetor, and a load increase for a throttle operation is caused in a hand operation machine.

An object of the present invention is to provide a transmissible connecting mechanism driving a lead air control valve and the throttle valve of an air-fuel mixture of a carburetor of a stratified scavenging two-cycle engine in an interlocking manner, wherein both of the valves can be driven compellingly in an interlocking manner both at a time of opening and closing the lead air control valve or the air-fuel mixture throttle valve.

Means to Solve Problems

Problems mentioned above are efficiently solved by means of first main structure of the present invention wherein the first main structure is a transmissible connecting mechanism driving a lead air control valve and an air-fuel throttle valve of a carburetor of a stratified scavenging two-cycle engine in an interlocking manner, wherein the transmissible connecting mechanism comprises a cam mechanism which forcibly drives a valve shaft of one of the lead air control valve and the air-fuel mixture throttle valve in an interlocking manner by a reciprocating rotation of a valve shaft of the other one of the lead air control valve and the air-fuel mixture throttle valve.

Further according to the preferred embodiment of the invention, cam mechanism comprises: a cam attached to the valve shaft of one of the lead air control valve and the air-fuel mixture throttle valve, integrally rotating with the one valve shaft and having a cam groove; and a lever attached to the valve shaft of the other one of the lead air control valve and the air-fuel mixture throttle valve, integrally rotating with the other valve shaft and having a contact element brought into contact with the cam groove, wherein the transmissible connecting mechanism is provided with springs respectively arranged in the one valve shaft and the other valve shaft, and urging the lead air control valve and the air-fuel mixture throttle valve in a valve closing direction.

Further, the problems mentioned above are also efficiently solved by means of second main structure of the present invention, wherein the second main structure is a transmissible connecting mechanism driving a lead air control valve and an air-fuel throttle valve of a carburetor of a stratified scavenging two-cycle engine in an interlocking manner, wherein the transmissible connecting mechanism comprises a gear mechanism which forcibly drives a shaft of one of the lead air control valve and the air-fuel mixture throttle valve in an interlocking manner by a reciprocating rotation of a shaft of the other one of the lead air control valve and the air-fuel mixture throttle valve.

Effect of the Invention

In accordance with the first main structure of the present invention, the transmissible connecting mechanism driving the lead air control valve and the air-fuel mixture throttle valve of the carburetor of the stratified scavenging two-cycle engine in the interlocking manner is characterized by the cam mechanism which can forcibly drive both of the respective valve shafts of the lead air control valve and the air-fuel mixture throttle valve in the interlocking manner at a time of rotating the valve shafts in the valve opening direction and the valve closing direction.

Accordingly, even in the case that the foreign particle or the like enters into the respective valve shafts of the lead air control valve and the air-fuel mixture throttle valve and the valve shafts do not normally function, it is possible to utilize a return spring force of the springs respectively arranged in the valve shafts of the lead air valve and the air-fuel mixture throttle valve of the carburetor via the cam mechanism according to the present invention as a resultant force and it is possible to apply to the respective valve shafts by using the resultant force.

Accordingly, even in the case that one valve shaft does not normally function, it is possible to rotate both of the valve shafts in the valve closing direction by a return force applied to the other valve shaft. Further, since it is possible to utilize the return spring forces of the respective springs as the resultant force so as to rotate both of the valve shafts in the valve closing direction, it is possible to decrease the spring forces of the springs arranged in both of the valve shafts, and it is possible to reduce the throttle operation load operating the opening and closing motion of the throttle valve of the carburetor.

Further, even in the case that both of the valve shafts can not be returned to the valve closing state even by combining the return spring forces of the springs at a time when one valve shaft generates a malfunction, for example, and even in the case that a malfunction is generated in the valve shaft of the lead air control valve and the valve shaft stops in a state in which the lead air control valve is open, an opening degree of the air-fuel mixture throttle valve is maintained in an opening degree corresponding to an opening degree of the lead air control valve. Accordingly, it is possible to supply a proper fuel corresponding to the lead air amount to the cylinder.

Accordingly, it is possible to avoid a situation that the air-fuel mixture is hardly supplied to the cylinder and a lot of lead air is supplied to the cylinder. Further, it is possible to prevent an engine trouble in which a lot of lead air is supplied, and a concentration of a fuel gas within the cylinder becomes lean, whereby the engine becomes in an over speed state, and the engine is burnt out or the like.

The structure can be made such that the cam mechanism is provided with a cam plate having a cam groove and a lever having a contact element brought into contact with the cam groove. Further, the springs urging the lead air control valve and the air-fuel mixture throttle valve in the valve closing direction can be arranged in the respective valve shafts of the lead air control valve and the air-fuel mixture throttle valve in a same manner as a conventional structure.

By employing the structure mentioned above as the cam mechanism, it is possible to forcibly drive both of the valve shafts in the interlocking manner at a time of rotating the respective valve shafts of the lead air control valve and the air-fuel mixture throttle valve in the valve opening direction and the valve closing direction. Further, even in the case that axes of the respective valve shafts of the lead air control valve and the air-fuel mixture throttle valve are arranged in a parallel state, or even in the case that they are arranged in a twisted state or a crossed state, it is possible to forcibly drive both of the valve shafts in the interlocking manner by appropriately changing a shape of the cam groove and a shape of the contact element in the cam mechanism.

In the cam mechanism according to the present invention, the structure can be made such that the valve shaft of the lead air control valve is rotated in the interlocking manner after the valve shaft of the air-fuel mixture throttle valve of the carburetor is rotated at a predetermined amount in the valve opening direction before the lead air control valve is interlocked. At this time, it is desirable that a gap is formed between the contact element and a cam surface in such a manner that the contact element is brought into contact with the cam surface of the cam groove after moving at a predetermined amount in a home position state of the lead air control valve and the air-fuel mixture throttle valve. Accordingly, it is possible to determine an angular range in which only the throttle valve of the carburetor can be opened without operating the lead air control valve, and it is possible to control an inflow of the lead air into the cylinder at an idling time or a starting time of the engine.

In accordance with the second main structure of the present invention, the transmissible connecting mechanism driving the lead air control valve and the air-fuel mixture throttle valve of the carburetor of the stratified scavenging two-cycle in the interlocking manner is characterized by the gear mechanism which can forcibly drive both of the respective valve shafts of the lead air control valve and the air-fuel mixture throttle valve in the interlocking manner at a time of rotating the valve shafts in the valve opening direction and the valve closing direction.

Accordingly, it is possible to forcibly drive both of the valve shafts in the interlocking manner in the rotation of both of the valve shafts in the valve opening direction and the valve closing direction, by engaging a gear attached to the valve shaft of the lead air control valve with a gear attached to the valve shaft of the air-fuel mixture throttle valve of the carburetor. The gear attached to the valve shaft of the lead air control valve and the gear attached to the valve shaft of the air-fuel mixture throttle valve of the carburetor can be structured so as to be directly engaged or be engaged via an intermediate gear.

Even in the case that the axes of the respective valve shafts of the lead air control valve and the air-fuel mixture throttle valve are arranged in a parallel state, or even in the case that they are arranged in a twisted state or a crossed state, it is possible to employ the gear mechanism in accordance with the present invention. In the case that the axes of the respective valve shafts of the lead air control valve and the air-fuel mixture valve are arranged in the parallel state, it is possible to forcibly drive both of the valve shafts in the interlocking manner, for example, by attaching a spur gear to both of the valve shafts.

Further, in the case that the axes of the respective valve shafts of the lead air control valve and the air-fuel mixture valve are arranged in the twisted state or the crossed state, it is possible to employ a bevel gear, a skew bevel gear or the like as the gear attached to both of the valve shafts. Further, it is possible to stably engage both of the valve shafts of the lead air control valve and the air-fuel mixture valve with first and second intermediate gears respectively, by attaching the first intermediate gear engaging with the gear attached to the valve shaft of the lead air control valve and the second intermediate gear engaging with the gear attached to the valve shaft of the air-fuel mixture throttle valve of the carburetor, to the shaft pivoting the intermediate gear so as to be apart from each other, and interposing, for example, a universal joint to a shaft portion between the first and second intermediate gears attached so as to be apart from each other. Accordingly, it is possible to forcibly drive both of the valve shafts in the interlocking manner.

In the case that the intermediate gear is interposed, it is possible to form both of the gear attached to the valve shaft of the lead air control valve and the gear attached to the valve shaft of the throttle valve of the carburetor as large-diameter gears. The structure can be made such that only the valve shaft of the air-fuel mixture throttle valve can be rotated at a predetermined amount in the valve opening direction before the rotation generated by the gear attached to the valve shaft of the air-fuel mixture throttle valve of the carburetor is transmitted to the gear attached to the valve shaft of the lead air control valve. At this time, it is desirable that a non-engagement portion is formed in a part of the gear attached to the valve shaft of the air-fuel mixture throttle valve.

In the case that a fan-shaped gear is used at least as the gear attached to the valve shaft of the air-fuel mixture throttle valve, it is desirable that the respective home positions are arranged in such a manner that the rotation is transmitted to the gear attached to the valve shaft of the lead air control valve after the fan-shaped gear is rotated at a predetermined amount. Alternatively, it is possible to form such a shape that an engagement portion is notched in a part of the fan-shaped gear attached to the valve shaft of the air-fuel mixture throttle valve. In these cases, the gear attached to the valve shaft of the lead aid control valve may be constituted by a fan-shaped gear or a gear in which the gear is formed all around the periphery.

Accordingly, it is possible to determine an angular range in which only the throttle valve of the carburetor can be opened without operating the lead air control valve, and it is possible to control an inflow of the lead air into the cylinder at an idling time or a starting time.

DESCRIPTION OF REFERENCE NUMERALS

Figure 1:
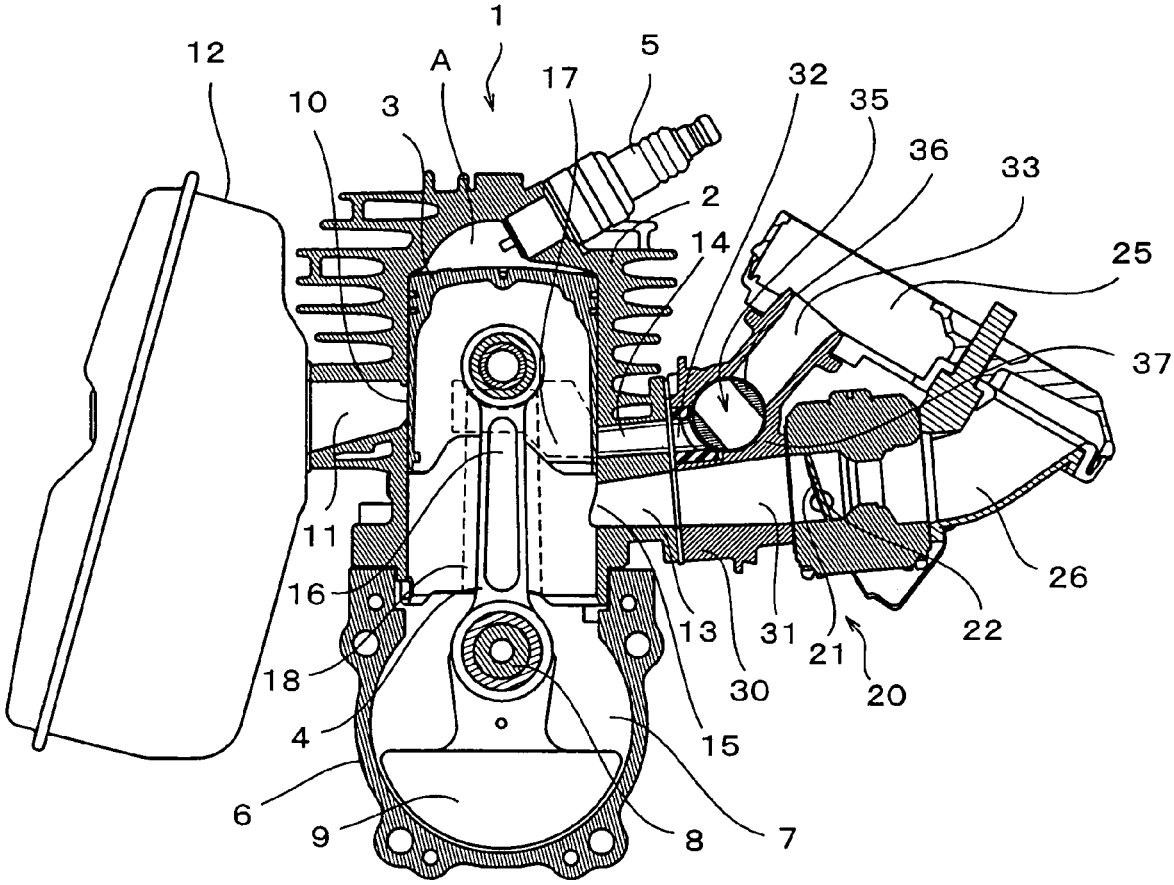
FIG. 1 is a schematic front elevational cross sectional view showing a general view of the present invention (embodiment).

1 stratified scavenging two-cycle engine
2 cylinder
3 piston
6 crank case
7 crank chamber
8 crank shaft
10 exhaust port
15 intake port
16 scavenging port
17 piston groove
18 scavenging flow path
20 carburetor
20*a* carburetor main body
21 air-fuel mixture throttle valve
22 valve shaft
23 lever
24, 24' contact element
27 valve shaft
28 cam plate
28*a*, 28*b* cam surface
35 rotary valve
45 spring
46 spring
47 gear
47*a* non-engagement portion
48 gear
49 intermediate gear
60 carburetor casing
62 throttle valve
63 throttle valve shaft
64 throttle valve
65 shaft
66 operation lever
68 restoring spring
69, 69' lever
71, 71' lever
72 drawbar
74 vertical slit
75 coil spring
76 transmissible connecting portion
77 idling path portion
80, 81 cam profile portion
82 diaphragm carburetor
A cylinder chamber

BEST MODE FOR CARRYING OUT THE INVENTION

A description of a preferable embodiment according to the present invention will be concretely given below with reference to accompanying drawings. A description will be given below of a transmissible connecting mechanism according to the present invention on the basis of an embodiment in which a rotary valve is used as a lead air control valve for a lead air in a stratified scavenging two-cycle engine. A throttle valve such as a butterfly type throttle valve or the like can be employed as the lead air control valve according to the present invention. Further, a description of a structure in which the butterfly type throttle valve is employed as an air-fuel mixture throttle valve in a carburetor will be given, however, a throttle valve such as a rotary valve or the like can be used as the air-fuel mixture throttle valve.

A structure of the stratified scavenging two-cycle engine or the like described below will be described as a typical structure of the stratified scavenging two-cycle engine or the like, and the transmissible connecting mechanism according to the present invention can be applied to a stratified scavenging two-cycle engine having other structures.

As a cam shape and a shape of a contact element or a shape of a gear in the transmissible connecting mechanism according to the present invention, it is possible to employ various shapes and layout relations as far as they can achieve the object of the present invention, in addition to a shape and a layout relation described below. Accordingly, the present invention is not limited to the embodiment described below, but can be variously modified.

Figure 2:
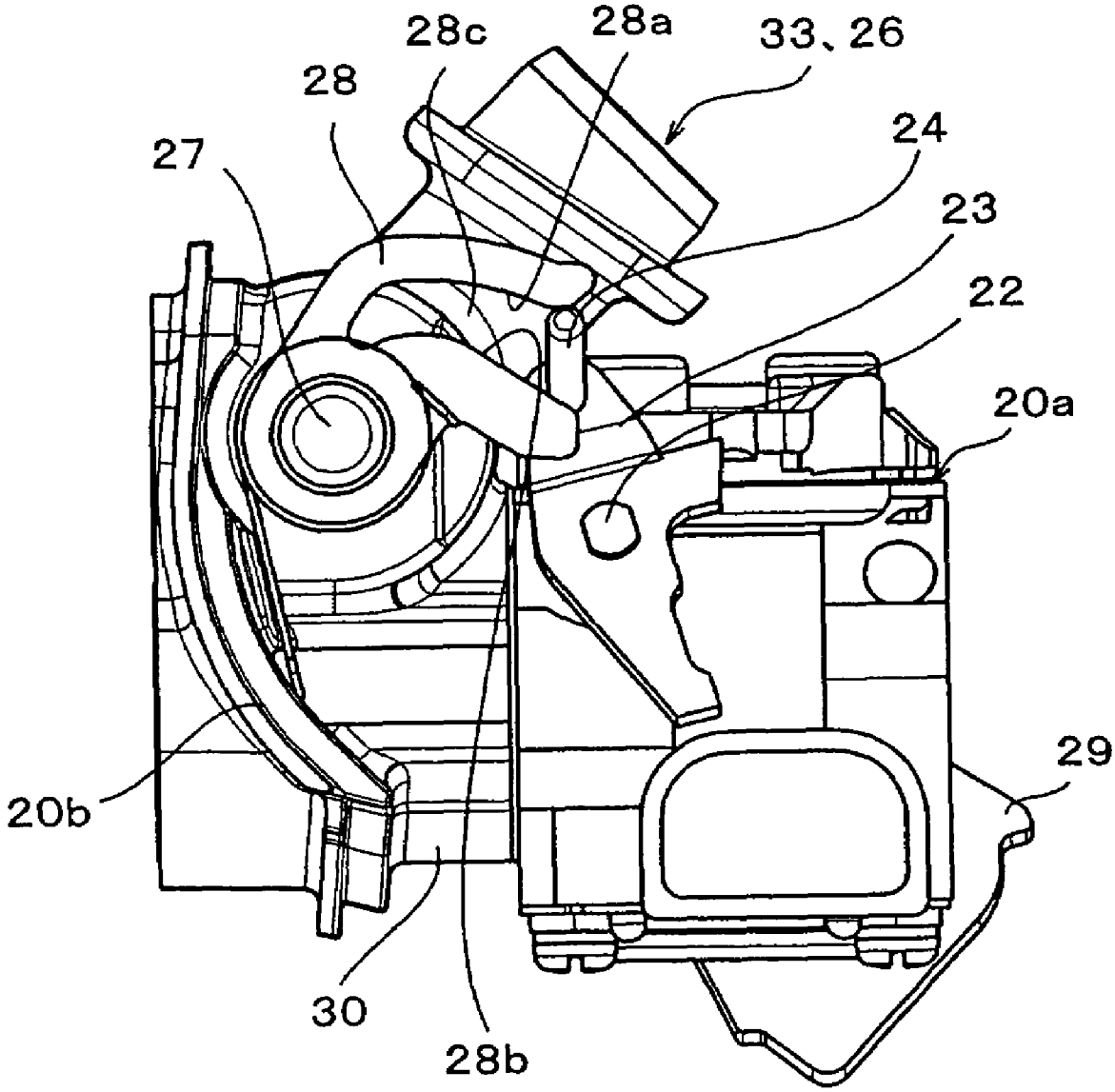
FIG. 2 is a partial plan view using a cam mechanism (first embodiment).
Figure 3:
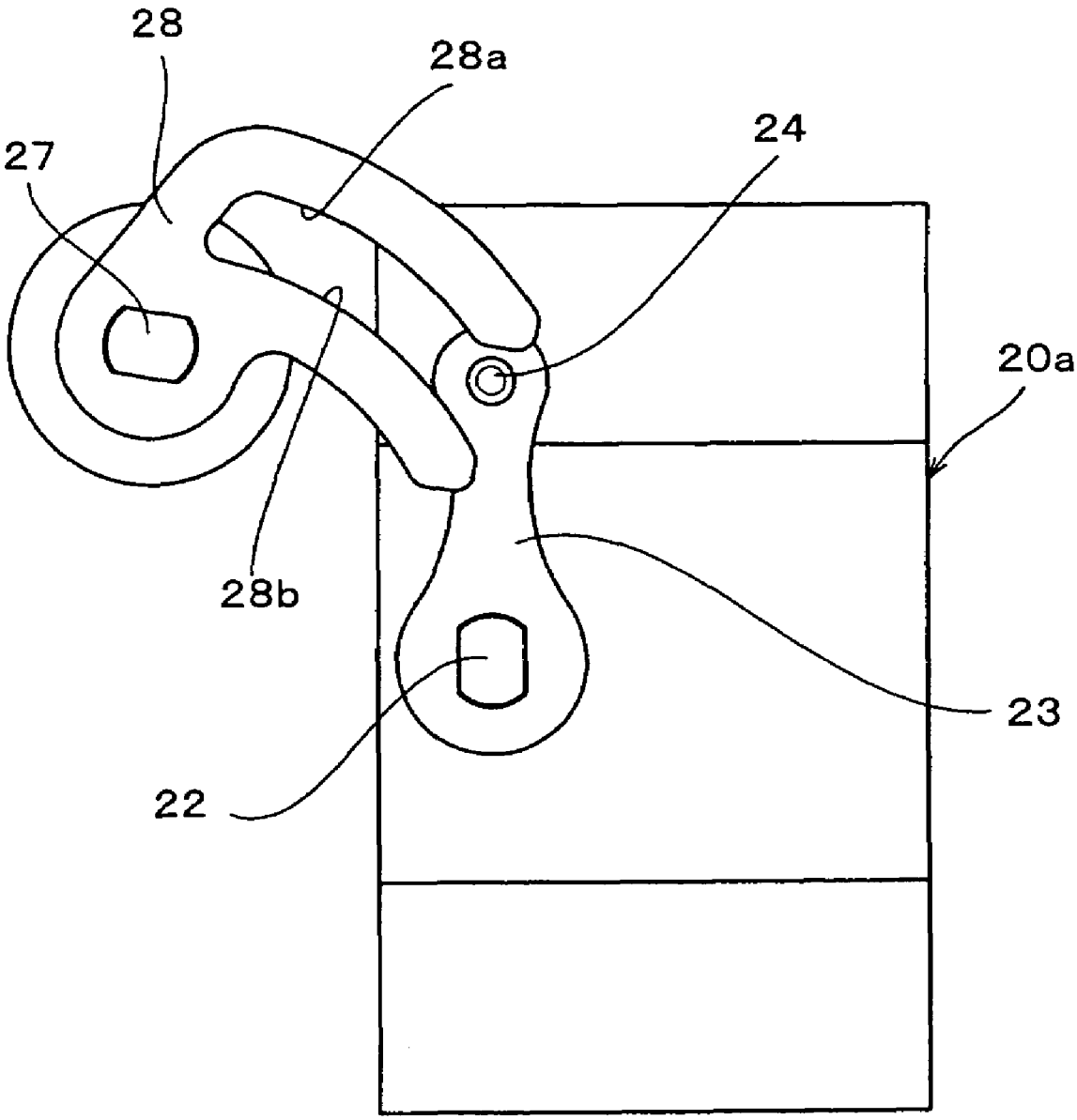
FIG. 3 is a view explaining an operation of the cam mechanism (first embodiment).
Figure 4:
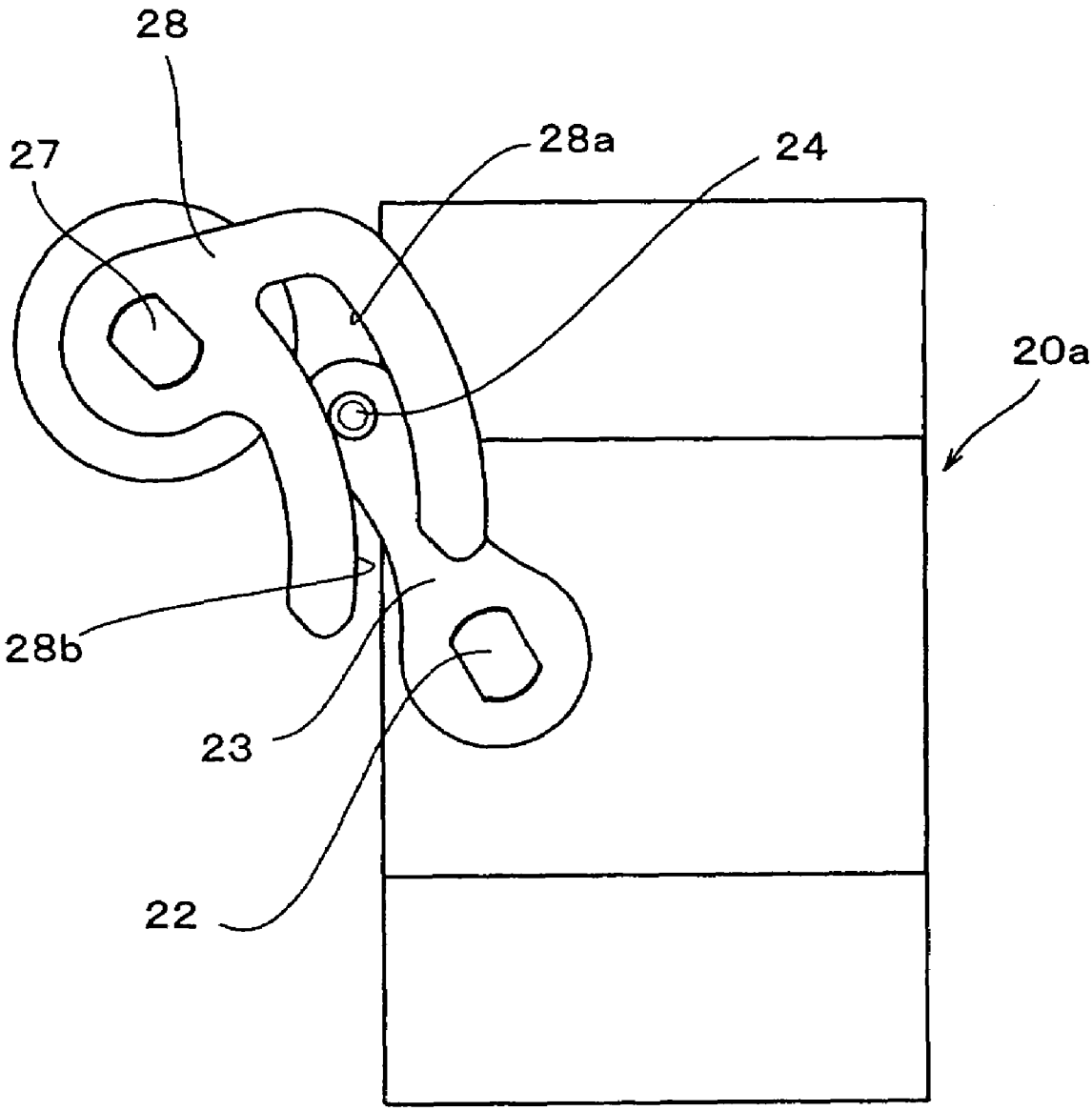
FIG. 4 is a second part of the view explaining the operation of the cam mechanism (first embodiment).
Figure 5:
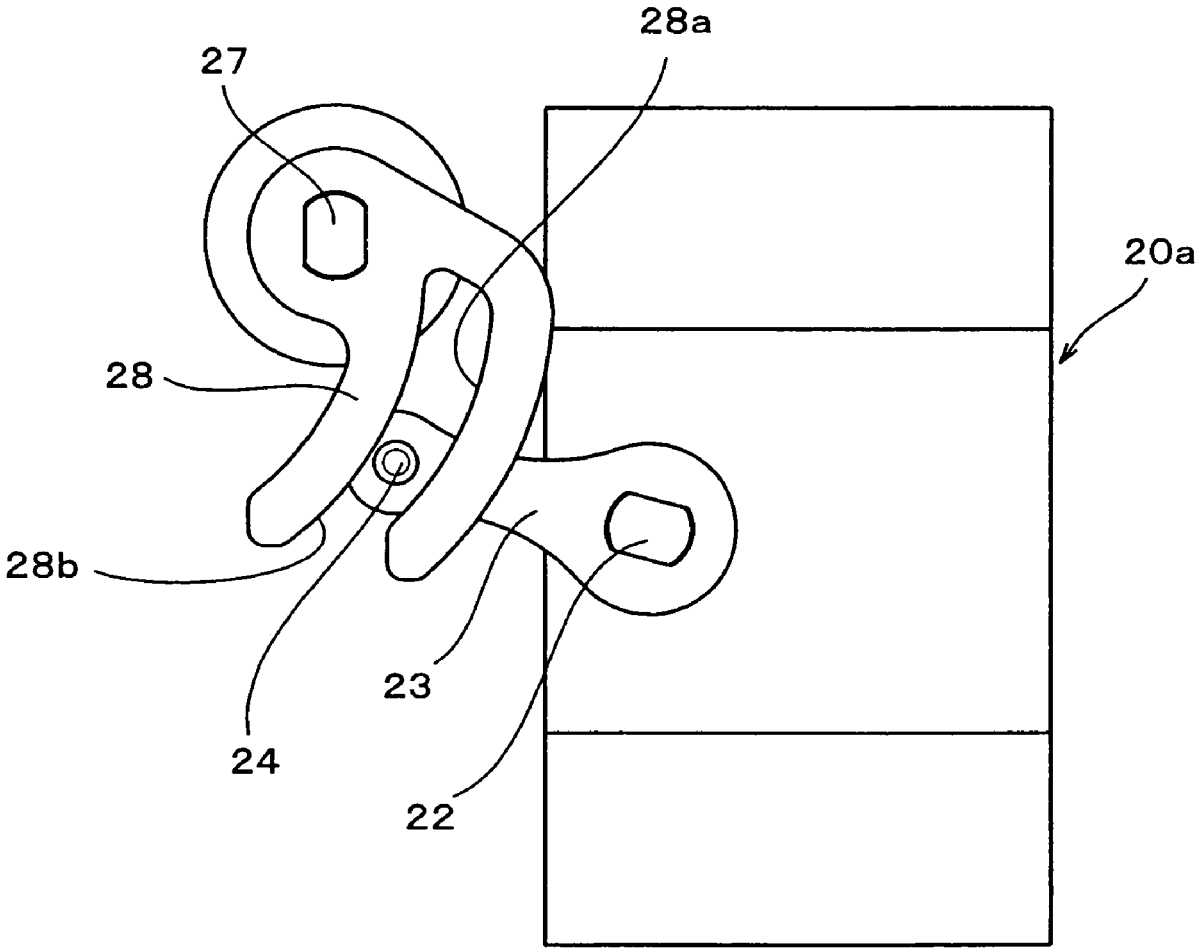
FIG. 5 is a third part of the view explaining the operation of the cam mechanism (first embodiment).
Figure 6:
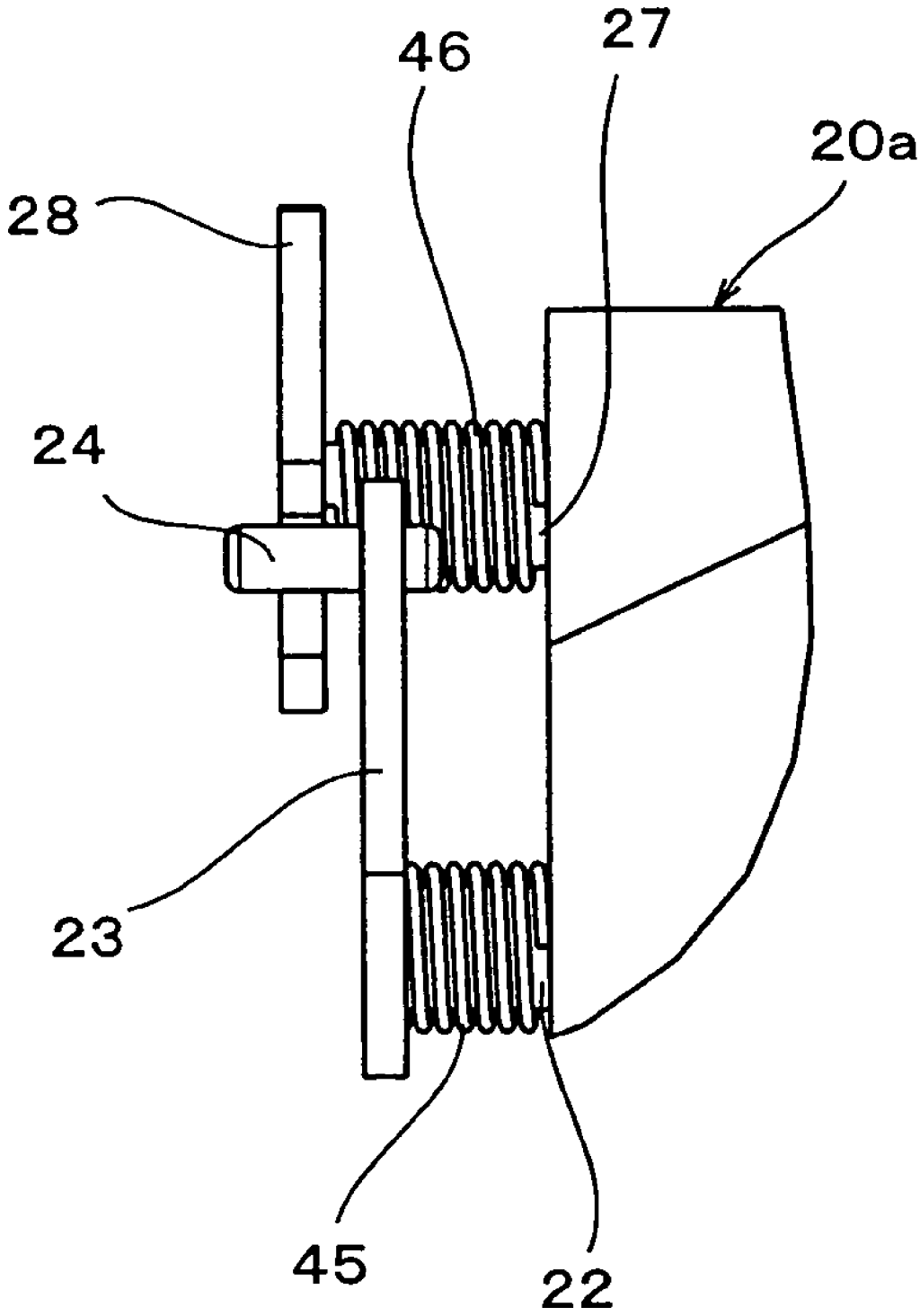
FIG. 6 is a schematic side elevational view of the cam mechanism (first embodiment).
Figure 7:
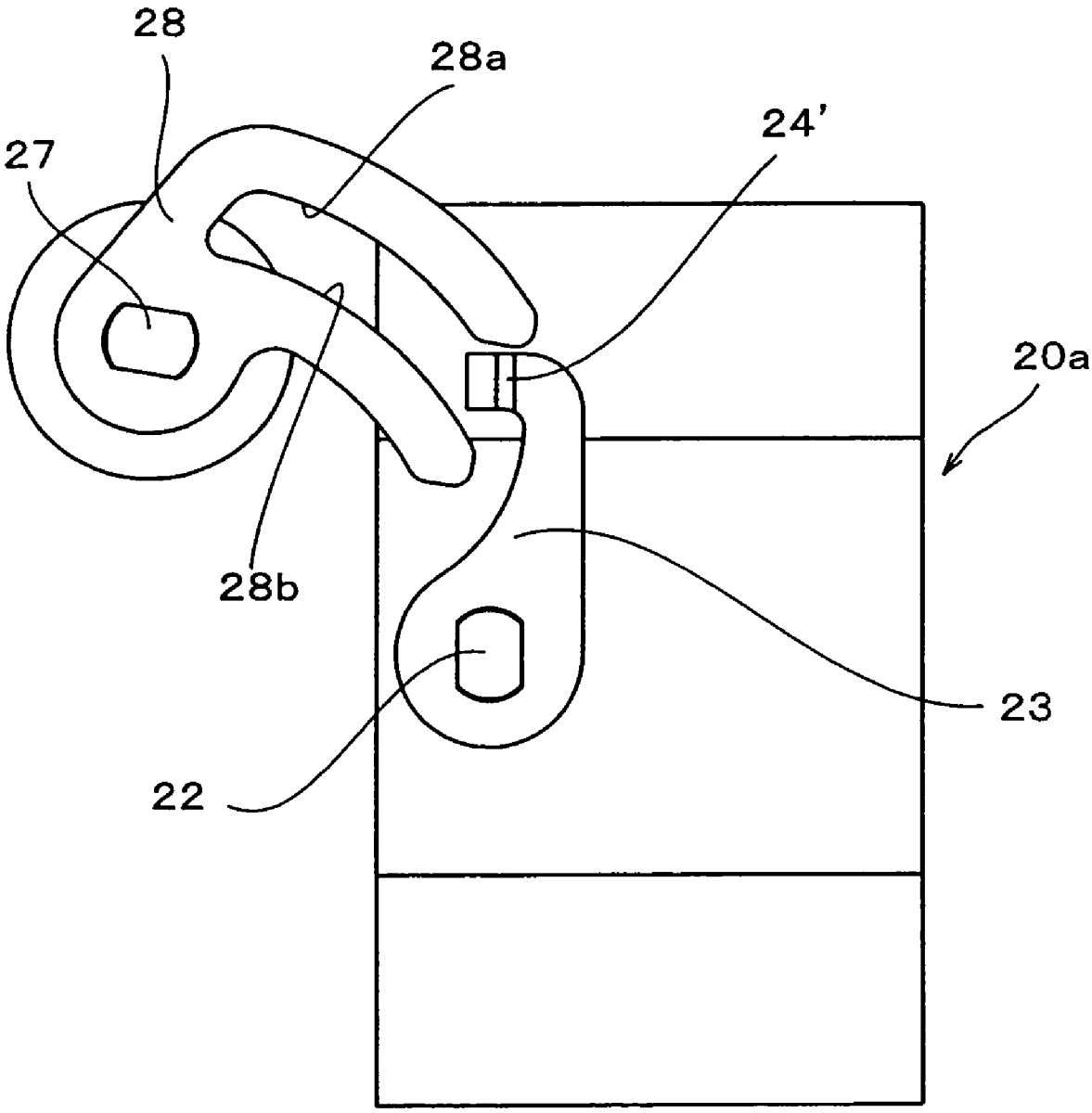
FIG. 7 is a view of a modified embodiment using the cam mechanism (first embodiment).
Figure 8:
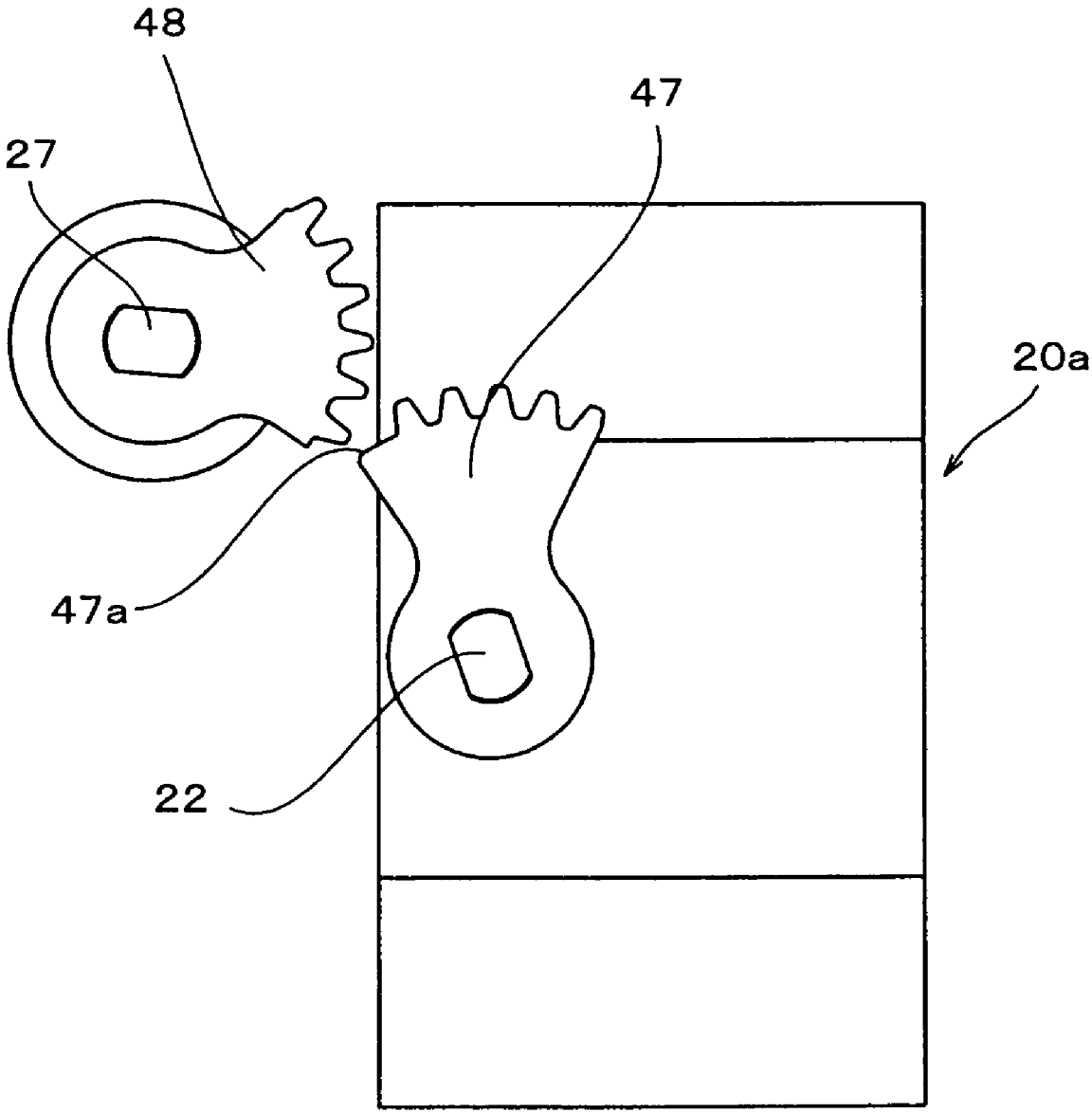
FIG. 8 is a view explaining an operation of a gear mechanism (second embodiment).
Figure 9:
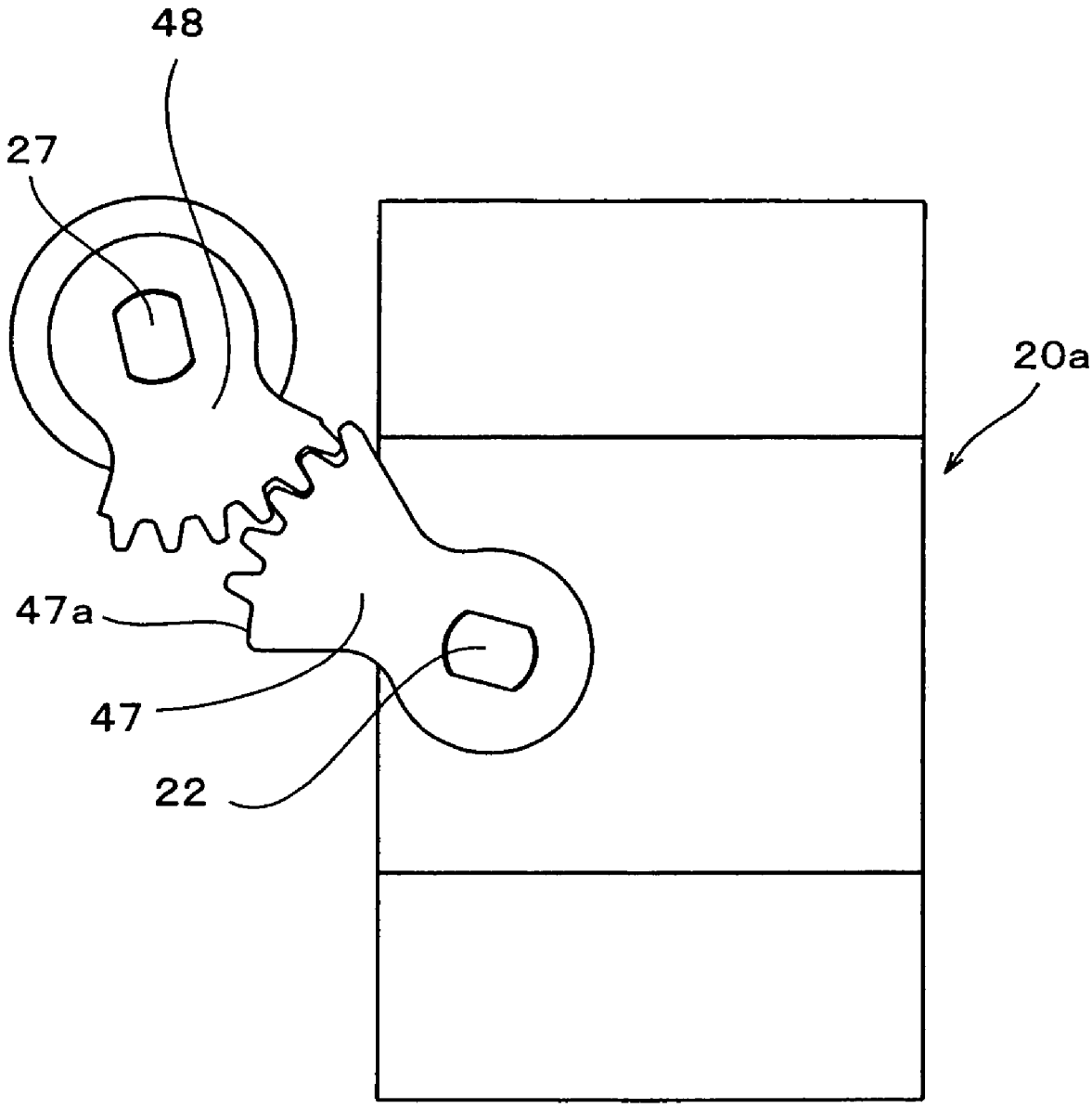
FIG. 9 is a second part of the view explaining the operation of the gear mechanism (second embodiment).
Figure 10:
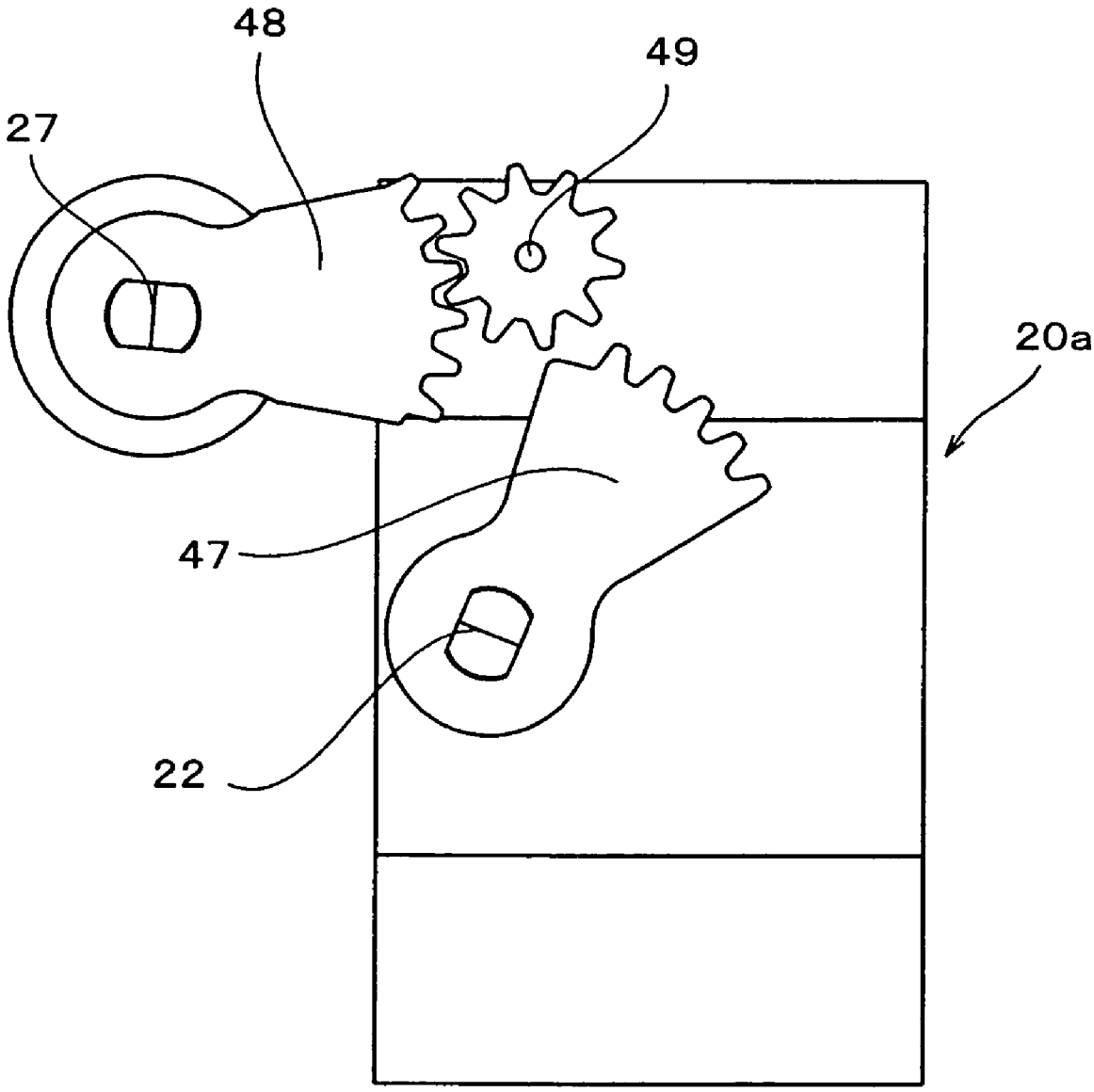
FIG. 10 is a view showing a modified example of the gear mechanism (second embodiment).
Figure 11:
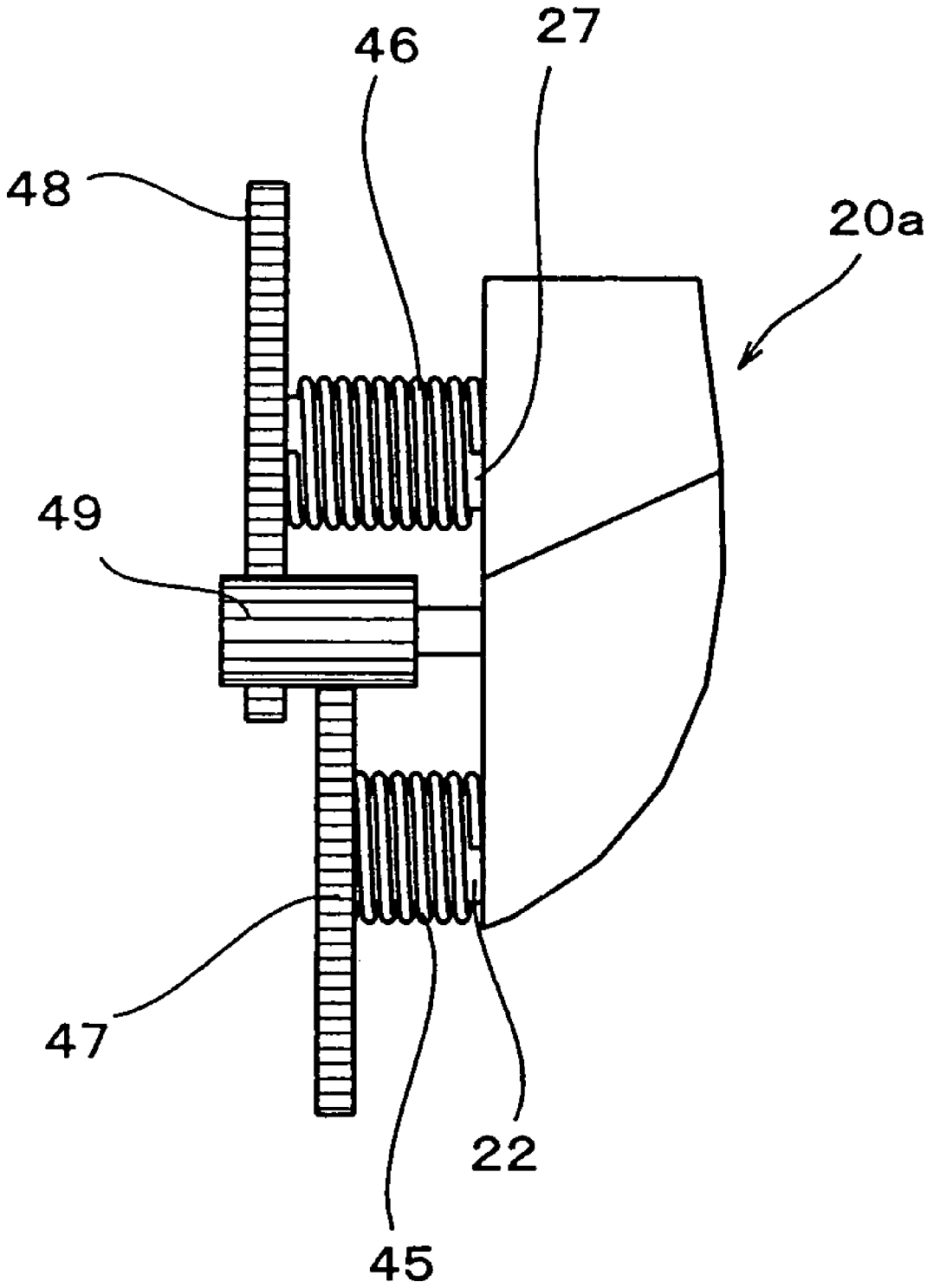
FIG. 11 is a side elevational view in the modified embodiment of the gear mechanism (second embodiment).
Figure 12:
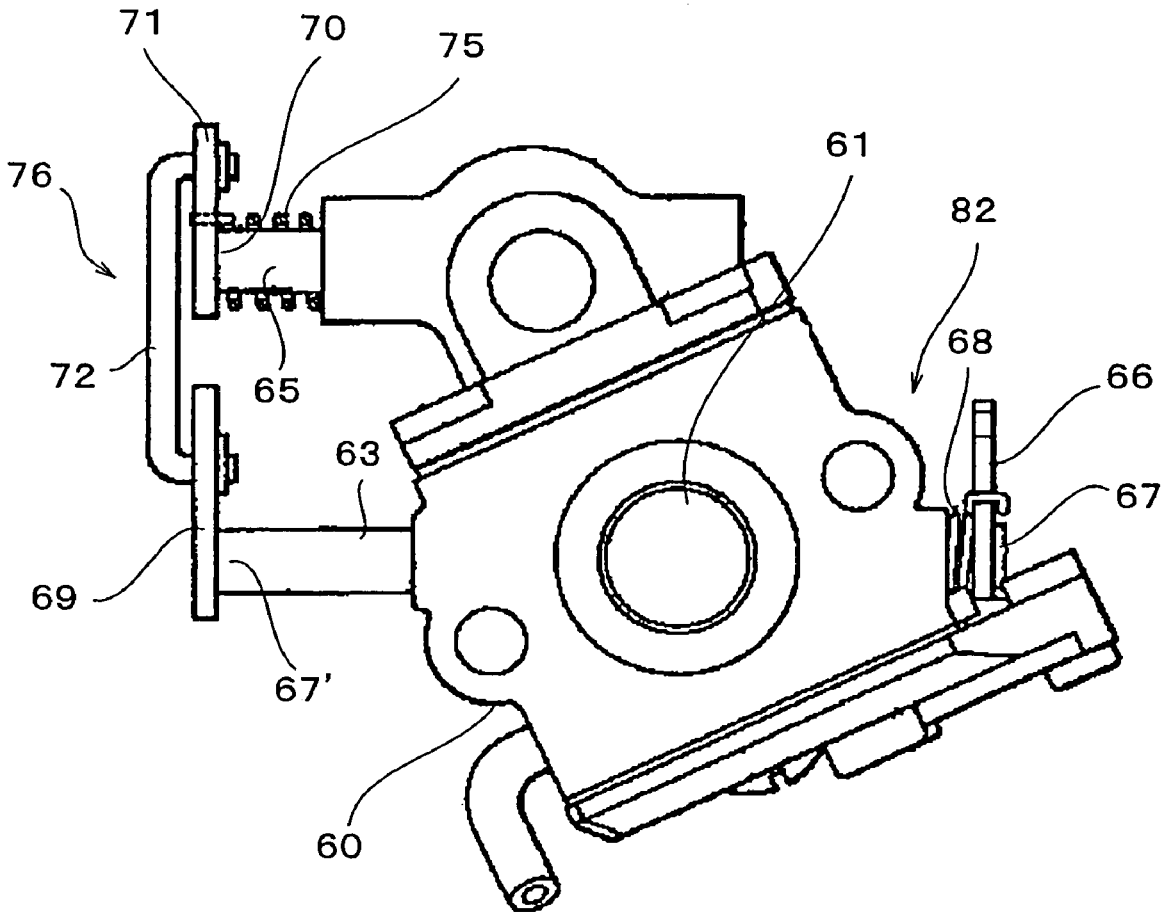
FIG. 12 PRIOR ART
FIG. 12 is a plan view of a diaphragm carburetor in accordance with a prior art (prior art).
Figure 13:
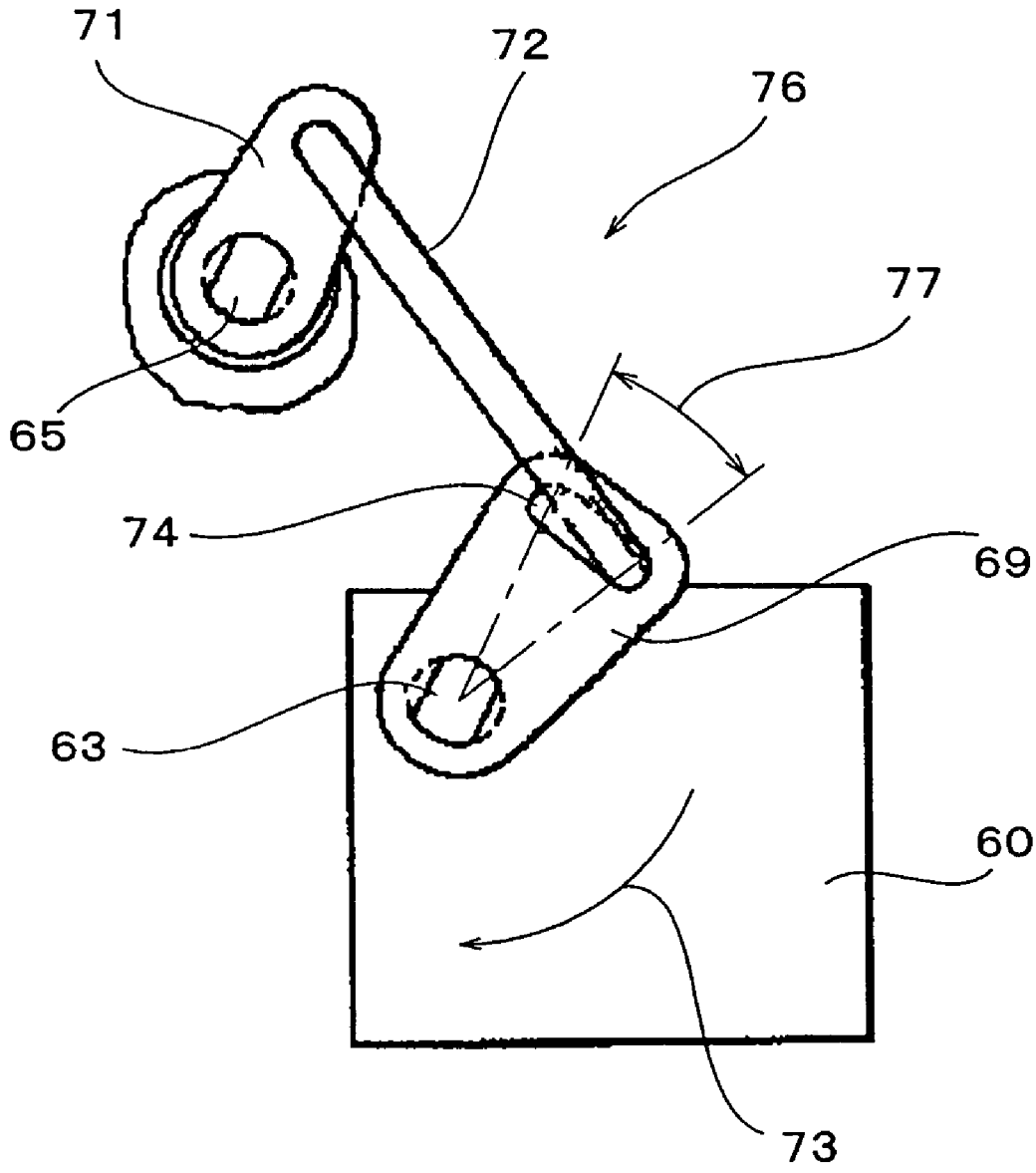
FIG. 13 PRIOR ART
FIG. 13 is a plan view as seen from a leftward direction in FIG. 12 (prior art).
Figure 14:
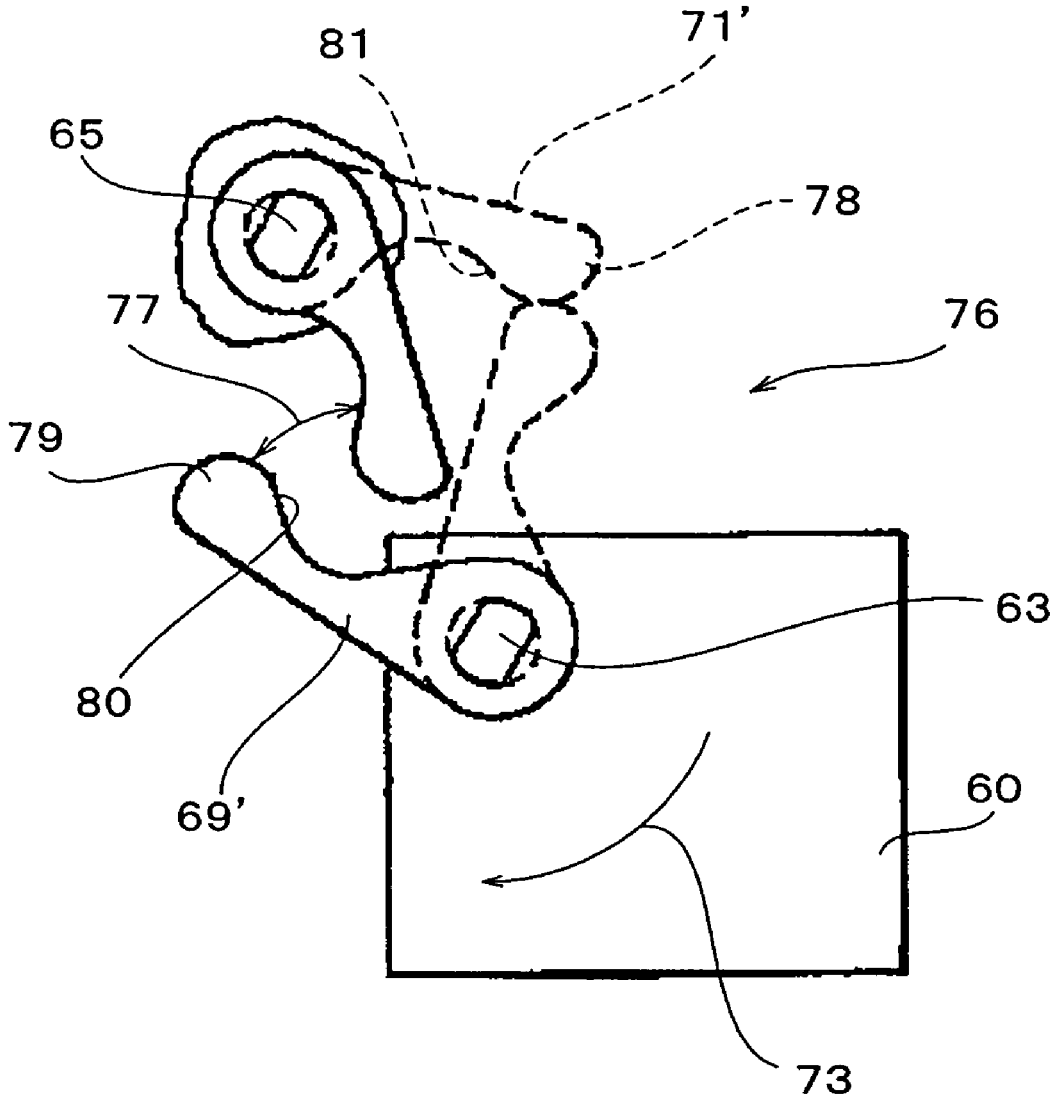
PRIOR ART FIG. 14
FIG. 14 is a plan view showing a cam mechanism in accordance with the prior art (prior art).

FIG. 1 is a front elevational cross sectional view of a stratified scavenging two-cycle engine in accordance with an embodiment of the present invention. FIG. 2 is a partial plan view of a stratified scavenging two-cycle engine using a cam mechanism as a transmissible connecting mechanism. FIGS. 3 to 5 are schematic views explaining operation conditions using the cam mechanism. FIG. 6 is a schematic side elevational view using the cam mechanism. FIG. 7 is a schematic explanatory view showing the other embodiment using the cam mechanism. FIGS. 8 and 9 are schematic views explaining operation conditions using a gear mechanism as the transmissible connecting mechanism. FIGS. 10 and 11 are schematic explanatory views showing the other embodiment using the gear mechanism.

First Embodiment

As shown in FIG. 1, in a stratified scavenging two-cycle engine 1, a piston 3 is slidably fitted to a cylinder 2 attached to an upper portion of a crank case 6. One end of a crank 9 rotatably borne within a crank chamber 7 is connected to a crank shaft 8 rotatably attached to a crank case 6, and the piston 3 is connected via a connecting rod 4. Further, a spark plug 5 is attached to a top portion of a cylinder 2.

An exhaust port 10 opening to an inner wall surface of the cylinder 2 is connected to a muffler 12 via an exhaust flow path 11. A scavenging port 16 opens to a portion slightly below the exhaust port 10 in an inner wall surface of the cylinder 2. The scavenging port 16 is communicated with the crank chamber 7 by a scavenging flow path 18. Further, the scavenging port 16 is communicated with a first lead air flow path 14 communicated with a rotary valve 35 serving as a lead air control valve via a piston groove 17 provided in an outer peripheral portion of the piston 3.

An intake port 15 open to the crank chamber 7 is formed in a lower portion of the inner wall surface of the cylinder 2, and the intake port 15 is communicated with a second intake flow path 31 communicating with a carburetor 20 via a first intake flow path 13.

The first intake flow path 13 and the first lead air flow path 14 are respectively connected to the second intake flow path 31 and a second lead air flow path 32 which are formed in an insulator 30 aiming at a heat insulation. Further, the rotary valve 35 serving as the lead air control valve is arranged in the insulator 30, and the rotary valve 35 rotates around a valve shaft 27 shown in FIG. 2. Further, a third lead air flow path 33 connected to the rotary valve 35 is formed in the insulator 30.

The second intake flow path 31 formed in the insulator 30 is connected to the carburetor 20, and the carburetor 20 is connected to a fuel tank (not shown) and an air cleaner 25. Further, a third lead air flow path 33 formed in the insulator 30 is connected to the air cleaner 25.

A butterfly type air-fuel mixture throttle valve 21 is provided in the carburetor 20, and can rotate around a valve shaft 22 so as to control a flow rate of an air-fuel mixture. An opening degree of the butterfly type air-fuel mixture throttle valve 21 is controlled by an operation lever 29 as shown in FIG. 2. The operation lever 29 is operated by a carburetor cable (not shown) or the like. Further, as shown in FIG. 2, a cam plate 28 is attached to an end portion of a valve shaft 27 of the rotary valve, and a cam groove 28c is formed in the cam plate 28. Further, a spring 46 is arranged as shown in FIG. 6 in the valve shaft 27, and urges the valve shaft 27 or the cam plate 28 in a direction of closing the rotary valve 35.

A lever 23 is attached to the valve shaft 22 of the air-fuel mixture throttle valve 21, and a contact element 24 engaging with a cam groove 28c of the cam plate 28 is arranged in the lever 23. Further, a spring 45 is arranged as shown in FIG. 6 in the valve shaft 22, and urges the valve shaft 22 or the lever 23 in a direction of closing the air-fuel mixture throttle valve 21. The spring 45 arranged in the valve shaft 22 can be arranged in a side of an operation lever 29 shown in FIG. 2, in place of being arranged in a side of the lever 23. A cam mechanism serving as the transmissible connecting mechanism is structured by the cam plate 28 and the lever 23.

It is possible to drive the rotary valve 35 serving as the lead air control valve and the air-fuel mixture throttle valve 21 of the carburetor 20 in an interlocking manner by the cam mechanism mentioned above, and the structure is made so as to control respective throttle amounts, that is, opening degrees. In this case, operations of the cam mechanism in detail will be described below with reference to FIGS. 3 to 5.

Next, a description of an operation of the stratified scavenging two-cycle engine 1 will be given. In the case that the air-fuel mixture compressed in a cylinder chamber A is ignited by a spark plug 5 at a top dead center of the piston 3 shown in FIG. 1, the air-fuel mixture is exploded so as to push down the piston 3.

At this time, a lead air purified by the air cleaner 25 is filled in the scavenging port 16 and the scavenging flow path 18. Further, an air-fuel mixture in which a fuel and an air purified by the air cleaner 25 are mixed in the carburetor 20 is filled in the crank chamber 7.

When the piston 3 moves downward, the intake port 15 is first closed, and the air-fuel mixture within the crank chamber 7 is compressed. In accordance with a downward movement of the piston 3, the exhaust port 10 is next opened, and combustion gas is discharged to an external portion through the exhaust flow path 11 via the muffler 12. Subsequently, the scavenging port 16 is opened, and the lead air flows into the cylinder chamber A from the scavenging port 16 by a pressure of the compressed air-fuel mixture within the crank chamber 7 so as to discharge the combustion gas left in the cylinder chamber A from the exhaust port 10.

Following to the inflow of the lead air into the cylinder chamber A, the air-fuel mixture within the crank chamber 7 flows into the cylinder chamber A, however, when the air-fuel mixture flows into the cylinder chamber A, the piston 3 is in a state of moving upward so as to close the exhaust port 10. Accordingly, it is possible to prevent a so-called blow-by phenomenon wherein the air-fuel mixture is discharged to the external portion as it is, it is possible to reduce an amount of hydrocarbon contained in the exhaust gas, and it is possible to reduce a dissipation of the fuel.

An amount of the air-fuel mixture passing through the carburetor 20 is controlled by the air-fuel mixture throttle valve 21, and an amount of the lead air is controlled by the rotary valve 35. Since the throttle amounts, that is, the opening degrees of the air-fuel mixture throttle valve 21 and the rotary valve 35 are controlled in an interlocking manner by the transmissible connecting mechanism, it is possible to always keep a balance between the amount of the air-fuel mixture and the amount of the lead air, and it is possible to execute a combustion under an optimum state.

Next, a description of operations of the cam mechanism will be given with reference to FIGS. 3 to 6. As shown in FIG. 3, a cam groove 28*c* in which an apical end portion is open is formed in the cam plate 28 attached to the valve shaft 27 of the rotary valve 35. Fork-shaped cam surfaces 28*a* and 28*b* are respectively formed in an inner surface of the cam groove 28*c*. The cam groove 28*c* can be formed as a closed cam groove in which an apical end portion is not open.

The lever 23 is attached to the valve shaft 22 of the air-fuel mixture throttle valve 21 in the carburetor 20, and a contact element 24 is arranged near an end portion of the lever 23. The contact element 24 can be structured such that a pin or a rotation roll is attached to portion near an end portion of the lever 23. Further, as shown in FIG. 7, it is possible to use a bent portion formed by bending the leading end portion of the lever 23, an inflected portion integrally formed with the lever 23 or the like as the contact element 24. It is possible to reduce a sliding resistance with respect to the cam surfaces 28*a* and 28*b* with which the contact element 24 is engaged, by forming the contact element 24 into a cylinder shape, a spherical shape, a rotation roll shape or the like so that the contact element 24 and the cam surfaces 28*a* and 28*b* are brought into line contact or point contact with each other.

FIG. 3 shows a state in which the lead air control valve and the air-fuel mixture throttle valve 21 are arranged in a home position state. When the valve shaft 22 is rotated in a counterclockwise direction by the operation of the operation lever 29 shown in FIG. 2, the valve shaft 27 of the lead air control valve is rotated in an interlocking manner after the valve shaft 22 is rotated at a predetermined amount in a counterclockwise direction. In other words, it is possible to rotate the valve shaft 22 of the air-fuel mixture throttle valve 21 of the carburetor 20 at a predetermined amount before rotating the valve shaft 27 of the lead air control valve in an interlocking manner on the basis of a gap formed between the contact element 24 and the cam surface 28*b* of the cam grove 28*c*. In this case, the description is given on an assumption that the air-fuel mixture throttle valve 21 is opened by the rotation of the valve shaft 22 in the counterclockwise direction in FIG. 3, and the lead air control valve is opened by the rotation of the valve shaft 27 in a clockwise direction.

It is possible to determine the gap between the contact element 24 and the cam surface 28*b* as an angular range in which only the air-fuel mixture throttle valve 21 of the carburetor can be open without operating the lead air control valve, and it is possible to control the inflow of the lead air into the cylinder at an idling time or a starting time by the gap.

In the case that the valve shaft 22 is further rotated in the counterclockwise direction by the operation of the operation lever 29 shown in FIG. 2, the contact element 24 and the cam surface 28*b* are engaged as shown in FIG. 4, and the cam plate 28 is rotated in a clockwise direction in FIG. 4. The valve shaft 27 is rotated by the rotation of the cam plate 28, and the rotary valve 35 shown in FIG. 1 is rotated so as to make the air cleaner 25 and the scavenging port 16 in a communicated state.

It is possible to interlock an opening degree of the rotary valve 35 with an opening degree of the air-fuel mixture throttle valve 21, by a cam mechanism structured with the cam plate 28, the lever 23 and the contact element 24, and it is possible to always keep a balance between an amount of the air-fuel mixture and an amount of the lead air so as to execute a combustion control in an optimum state.

When it is intended to return and rotate the air-fuel mixture throttle valve 21 in a valve closing direction, that is, a clockwise direction in FIG. 5 by operating the operation lever 29 shown in FIG. 2 from a full open state of the rotary valve 35 and the air-fuel mixture throttle valve 21 shown in FIG. 5, the cam plate 28 and the lever 23 are rotated by respective return forces of a spring 46 provided in the valve shaft 27 and a spring 45 provided in the valve shaft 22 shown in FIG. 6, and it is possible to rotate the rotary valve 35 and the air-fuel mixture throttle valve 21 in a valve closing direction, that is, return to the home position state.

For example, in the case that a foreign particle or the like enters into the valve shaft 22 and the valve shaft 22 is not normally operated, the contact element 24 is pressed by the cam surface 28*b* of the cam plate 28 returned and rotated by the spring 46, whereby it is possible to rotate the lever 23 in the clockwise direction in FIG. 5. On the contrary, in the case that the foreign particle or the like enters into the valve shaft 27 and the valve shaft 27 is not normally operated, it is possible to rotate the cam plate 28 in the counterclockwise direction in FIG. 5 by a pressing of the cam surface 28*a* by the contact element 24.

Even in the case that, for example, the foreign particle or the like enters into the valve shaft 27, the valve shaft 27 is not normally operated, and the cam plate 28 is not rotated even by the pressing to the cam surface 28*a* by the contact element 24, that is, the valve shaft 27 stops in a state in which the lead air control valve is open, the opening degree of the air-fuel mixture throttle valve 21 of the carburetor 20 can maintain a proper opening degree in correspondence to the opening degree of the lead air control valve. Accordingly, it is possible to supply a proper fuel to the cylinder. Therefore, it is possible to prevent a damage applied to the engine which is generated by an overheat or an over speed of the engine.

Further, for example, in the case that the foreign particle or the like enters into the valve shaft 22, the valve shaft 22 is not normally operated, and the lever 23 is not rotated by the pressing of the cam surface 28*b*, it is possible to maintain the opening degree of the air-fuel mixture throttle valve 21 of the carburetor 20 to a proper opening degree corresponding to the opening degree of the lead air control valve in a same manner as the case mentioned above.

Accordingly, it is possible to forcibly drive the valve shaft 22 and the valve shaft 27 in an interlocking manner in the valve opening direction and the valve closing direction of the valve shaft 22, and even in the case that the valve shafts 22 and 27 are not normally operated, it is possible to avoid an abnormal state of the engine. Further, it is possible to utilize the respective return spring forces of both of the springs 45 and 46 as a resultant force without making the return spring forces of the springs 45 and 46 arranged in the valve shafts 22 and 27 strong. Accordingly, it is possible to forcibly drive the valve shaft 22 and the valve shaft 27 in an interlocking manner without increasing an operation force of the operation lever 29 shown in FIG. 2, and even in the case that the valve shafts 22 and 27 are not normally operated, it is possible to avoid an abnormal state of the engine.

Second Embodiment

FIGS. 8 and 9 show schematic views of a second embodiment using a gear mechanism as the transmissible connecting mechanism. Further, FIGS. 10 and 11 show schematic views of a modified embodiment using the gear mechanism. The second embodiment is provided with the same structures as those of the first embodiment except the structure in which the gear mechanism is used as the transmissible connecting mechanism forcibly driving the valve shaft 22 and the valve shaft 27 in an interlocking manner. Accordingly, a description of members will be omitted by using the same reference numerals as those used in the first embodiment.

FIGS. 8 and 9 show a structure in which a gear 47 attached to the valve shaft 22 and a gear 48 attached to the valve shaft 27 are directly engaged and a rotation of the valve shaft 22 is driven in an interlocking manner as a rotation of the valve shaft 27. Although an illustration is omitted in FIGS. 8 and 9, the springs 45 and 46 are respectively arranged in the valve shafts 22 and 27 as shown in FIGS. 6 and 11, and apply a force in a valve closing direction as a return force to the valve shafts 22 and 27.

As shown in FIGS. 8 and 9, an engagement portion is not formed all around a periphery of a circle in each of approximately fan-shaped gears 47 and 48, and is partly formed only in a range in which both of the gears 47 and 48 can engage within rotation ranges of the valve shafts 22 and 27. As the gears 47 and 48 in the gear mechanism according to the present invention, it is possible to employ a shape in which the engagement portion is formed all around a periphery of a circle.

Further, as shown in FIG. 8, it is possible to determine a section in which an engagement portion 47*a* is notched as an angular range in which only the air-fuel mixture throttle valve 21 of the carburetor can open without operating the lead air control valve, by forming the gear 47 in a shape in which a part of the engagement portion 47*a* is notched. It is possible to control the inflow of the lead air into the cylinder at the idling time or the starting time by a notched section and an apart section. Alternately, it is possible to set a non-contact state in which an end portion of the approximately fan-shaped gear 47 is apart from the gear 48 as a home position.

It is possible to structure a shape of an engagement portion such as a spur gear, a bevel gear or the like as a shape of the gears 47 and 48 in correspondence to respective layout relations of the valve shafts 22 and 27 such as a layout relation in which the valve shafts 22 and 27 are arranged in a parallel state, in a crossed state or a twisted state.

Further, as shown in FIGS. 10 and 11, it is possible to drive the gear 47 and the gear 48 in an interlocking manner via an intermediate gear 49. In this case, it is possible to use a large-diameter gear in comparison with the gear shown in FIGS. 8 and 9. In this case, as shown in FIG. 11, the springs 45 and 46 are arranged respectively in the valve shafts 22 and 27, and a force in a valve closing direction is applied as a return force to the valve shafts 22 and 27.

Further, in the case that the intermediate gear 49 is divided into a first intermediate gear engaging with the gear 47 and a second intermediate gear engaging with the gear 48, and a universal joint is interposed between the first intermediate gear and the second intermediate gear, it is possible to respectively arrange rotation shafts of the first and second intermediate gears in a parallel state to the valve shafts 22 and 27, even in the case that the valve shafts 22 and 27 are arranged in a crossed state or a twisted state.

Even in the case that the intermediate gear 49 is used as shown in FIGS. 10 and 11, it is possible to set an angular range in which only the air-fuel mixture throttle valve 21 of the carburetor is open without operating the lead air control valve, by employing a structure in which a part of the engagement portion 47*a* engaging with the intermediate gear 49 of the gear 47 is notched, or a structure in which a non-engagement section is formed.

Accordingly, it is possible to forcibly drive the valve shaft 22 and the valve shaft 27 in the interlocking manner in the valve opening direction and the valve closing direction of the valve shaft 22, and it is possible to avoid the abnormal state of the engine even in the case that the valve shafts 22 and 27 are not normally operated. Further, it is possible to utilize the resultant force of the return spring forces of both of the springs 45 and 46 without making the return spring forces of the springs 45 and 46 arranged in the valve shafts 22 and 27 strong. Accordingly, it is possible to forcibly drive the valve shaft 22 and the valve shaft 27 in the interlocking manner without increasing the operation force of the operation lever 29 shown in FIG. 2, and it is possible to avoid the abnormal state of the engine even in the case that the valve shafts 22 and 27 are not normally operated.

INDUSTRIAL APPLICABILITY

The present invention provides the transmissible connecting mechanism for driving the lead air control valve and the air-fuel mixture throttle valve of the carburetor of the stratified scavenging two-cycle engine in the interlocking manner, in which the transmissible connecting mechanism can forcibly drive the lead air control valve and the air-fuel mixture throttle valve in the interlocking manner both at a time of opening and closing the lead air control valve or the air-fuel mixture throttle valve. However, the technical idea of the present invention can be applied to an apparatus or the like to which the technical idea of the present invention can be applied.

The invention claimed is:

1. A transmissible connecting mechanism driving a lead air control valve and an air-fuel throttle valve of a carburetor of a stratified scavenging two-cycle engine in an interlocking manner, wherein the transmissible connecting mechanism comprises a cam mechanism which forcibly drives a valve shaft of one of the lead air control valve and the air-fuel mixture throttle valve in an interlocking manner by a reciprocating rotation of a valve shaft of the other one of the lead air control valve and the air-fuel mixture throttle valve, the cam mechanism comprising a cam attached to the valve shaft of one of the lead air control valve and the air-fuel mixture throttle valve, integrally rotating with the one valve shaft and having a cam groove, and a lever attached to the valve shaft of the other one of the lead air control valve and the air-fuel mixture throttle valve, integrally rotating with the other valve shaft and having a contact element brought into contact with the cam groove, and the transmissible connecting mechanism is provided with springs respectively arranged in the one valve shaft and the other valve shaft, and urging the lead air control valve and the air-fuel mixture throttle valve in a valve closing direction.

* * * * *